US006457991B1

(12) United States Patent
Yu

(10) Patent No.: US 6,457,991 B1
(45) Date of Patent: Oct. 1, 2002

(54) ELECTRICAL CONNECTOR COUPLE HAVING MATING INDICATION DEVICE

(75) Inventor: Hung-Chi Yu, Hsi-Chih (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/006,581

(22) Filed: Nov. 30, 2001

(51) Int. Cl.[7] ..... H01R 3/00
(52) U.S. Cl. ..... 439/489; 439/660
(58) Field of Search ..... 439/488, 489, 439/660, 65, 74

(56) References Cited

U.S. PATENT DOCUMENTS 5,257,944 A * 11/1993 Kennedy ..... 439/489
5,462,450 A * 10/1995 Kodama ..... 439/489
6,019,629 A * 2/2000 Ito et al. ..... 439/489
6,361,347 B1 * 3/2002 Murakami et al. ..... 439/352

* cited by examiner

*Primary Examiner*—Hien Vu
(74) *Attorney, Agent, or Firm*—Wei Te Chung

(57) ABSTRACT

A connector couple having a device for indicating the connector mating situation, comprises a first connector and a second connector. The first and second connectors have first and second insulative housings respectively. A spring tab is formed on the second insulative housing, and a recess is opened in the first insulative housing corresponding to the spring tab. The recess comprises a guide portion and a locating portion. The guide portion is formed as an inclined surface and vertically spaced apart from the locating portion. When the first connector is mated with the second connector, the spring tab will slide on the inclined surface and finally hit on the locating portion, whereby a sound made by the hit can indicate the completeness of the mating of the connectors.

1 Claim, 4 Drawing Sheets

ELECTRICAL CONNECTOR COUPLE HAVING MATING INDICATION DEVICE

BACKGROUND OF THE INVENTION

1. Field of the Invention

The present invention relates to electrical connectors, and more particularly to an electrical connector couple having an indication device for indicating mating situation of the connector couple.

2. Description of the Prior Art

Conventional board to board (BTB) connector assembly comprises a first connector and a second connector. Due to space limitation, the configuration of the BTB connector is small and this results in that housing of the BTB connector is fragile, such that when the first and second connectors are mating, inappropriate mating force will damage the connectors. The conventional BTB connector cannot indicate the mating situation of the connectors, so there will be two undesired conditions. One condition is that the connectors have mated completely, but the user does not know and still pushes the BTB connectors together. This may result in damage of contacts and even the housing of the BTB connector. The second condition is that the connectors have not mated completely, but the user does not know and stops pushing the BTB connectors together. This may result in failure of electrical connection between the first and second connectors.

As shown in FIG. 6, a BTB connector assembly or couple comprises a first connector with a first insulative housing 90 and a second connector with a second insulative housing 92. When the first connector is mated with the second connector, sidewalls 96 of the first connector 90 will be pressed into a receiving portion 98 of the second connector 92, then first contacts 94 of the first connector 90 will be pressed against and electrically connected with second contacts 95 of the second connector 92. As the sidewalls and contacts of the BTB connector are fragile and easy to be damaged, when the BTB connector assembly is mated, the user cannot determine whether the connector couple has completely mated, and this can result in the two conditions described above.

Accordingly, a BTB connector couple with mating situation indicating device is desired to overcome the shortcoming of the conventional BTB connector.

SUMMARY OF THE INVENTION

An object of the present invention is to provide an electrical connector couple having a mating indication device for indicating the mating situation of the connector couple.

To achieve the above object, an electrical connector couple in accordance with a preferred embodiment of the present invention comprises a first connector and a second connector. The first connector comprising a first insulative housing having a concave portion, the concave portion defining a second connector mated with the first connector. The second connector comprising a second insulative housing having an island portion, the insulative portion defining a mating indication device comprising a recess defined in the first mating surface, and a spring tab formed correspondingly on the second mating surface, the recess having vertical wall, when the first and second connectors are mated together completely, the spring tab dropping across the vertical wall to hit the recess, thereby making a sound to indicate the completeness of the mating of the first and second connectors.

Other objects, advantages and novel features of the present invention will be drawn from the following detailed description of preferred embodiment of the present invention with attached drawings, in which:

DESCRIPTION OF PREFERRED EMBODIMENT OF THE INVENTION

The present invention will be explained in detail by reference to the following description of the preferred embodiment.

Figure 1:
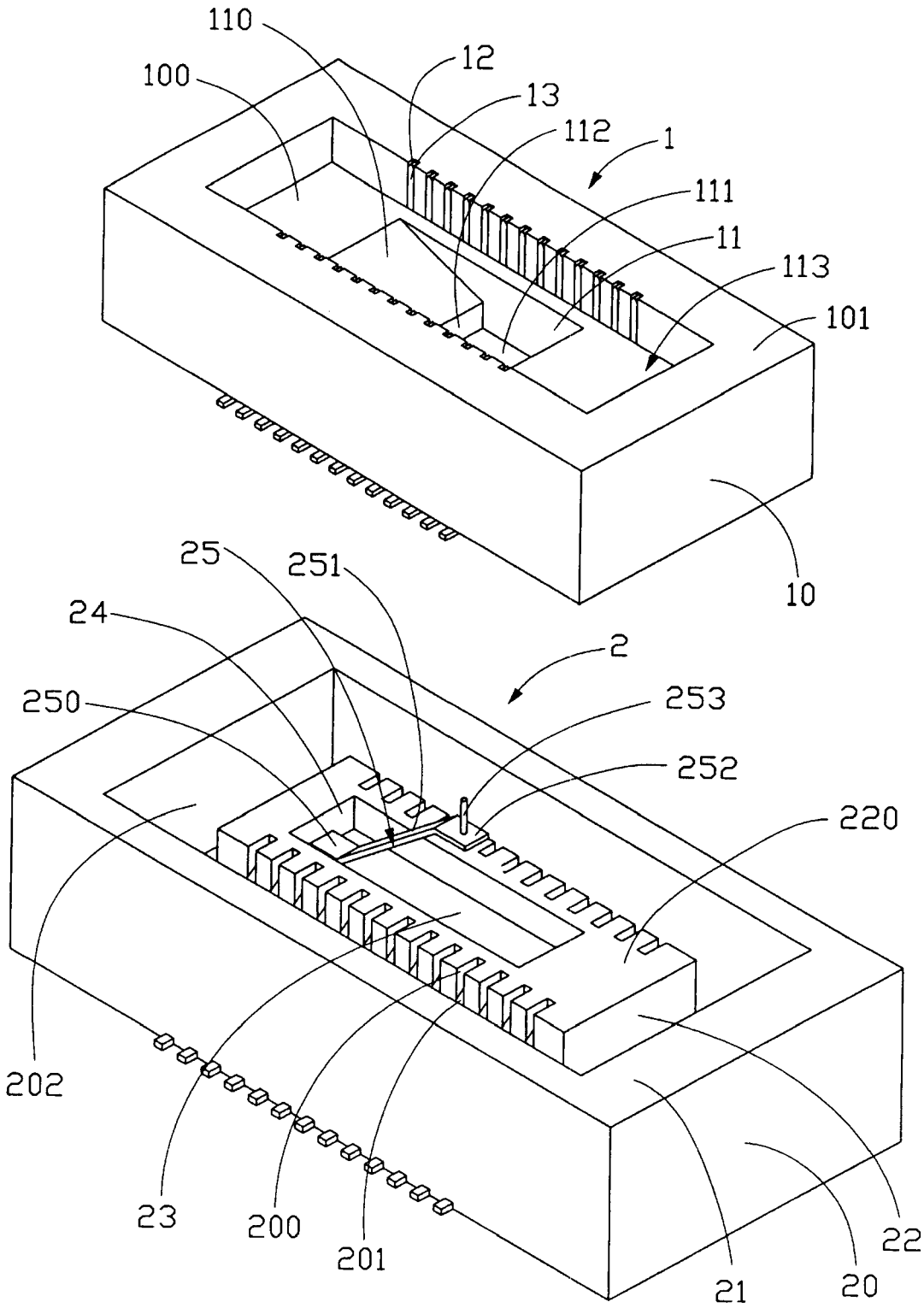
FIG. 1 is a perspective view of a connector couple in accordance with a preferred embodiment of the present invention.
Figure 2:
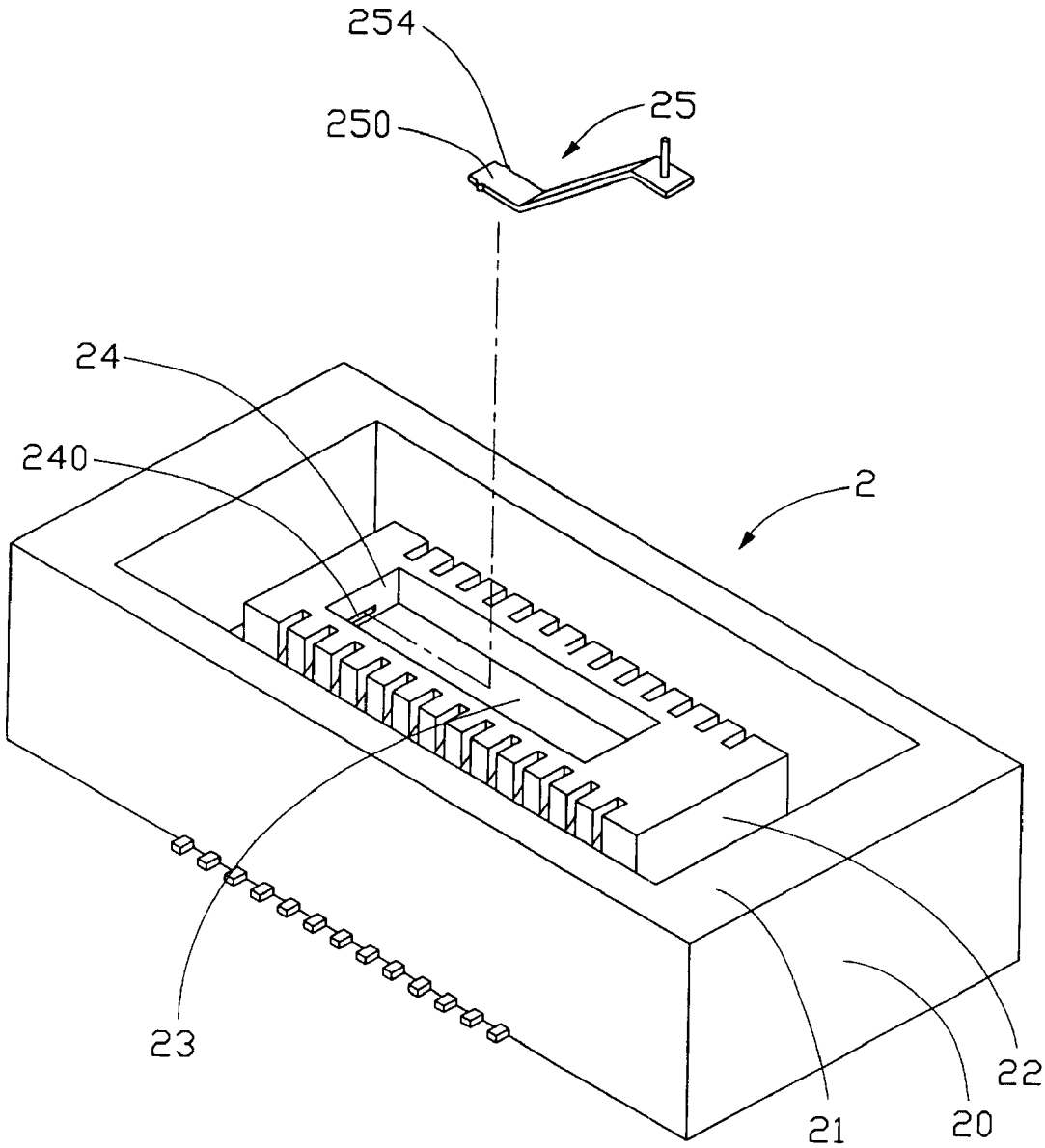
FIG. 2 is an exploded view of a second connector of FIG. 1.

As shown in FIGS. 1 and 2, a BTB connector couple in accordance with a preferred embodiment of the present invention comprises a first connector 1 and a second connector 2. The first connector 1 comprises a first insulative housing 10. The second connector 2 comprises a second insulative housing 20. The first insulative housing 10 comprises a concave section 100 with a first mating surface 113 defined thereon, a raised portion 101 comprising a plurality of first contact-receiving passages 12 for receiving first contacts 13. A recess 11 is defined in the first mating surface 113. The recess 11 comprises a guide portion 110 and a locating portion 111. A vertical wall 112 is defined between the guide portion 110 and the locating portion 111. For engaging with the first connector 1, the second insulative housing 20 has an island portion 22 with a second mating surface 220 defined thereon. A receiving portion 202 is formed between the insulative housing wall 21 and the island portion 22. Second contact-receiving passages 200 are defined in the island portion 22 for receiving the second contacts 201. A hollow portion 23 is defined in the second mating surface 220. A spring tab 25 is disposed in the hollow portion 23. The spring tab 25 comprises a retention portion 250, a contact portion 252, and an extending portion 251 between the retention portion 250 and the contact portion 252. A pin 253 functioning as a sound generator, is formed on the contact portion 252. A plurality of barbs 254 is formed on the retention portion 250 of the spring tab 25, and a hole 240 is defined in a sidewall 24 of the hollow portion 23. The barbs 254 are interferentially received in the hole 240, whereby the spring tab 25 is secured in the hollow portion 23.

Figure 3:
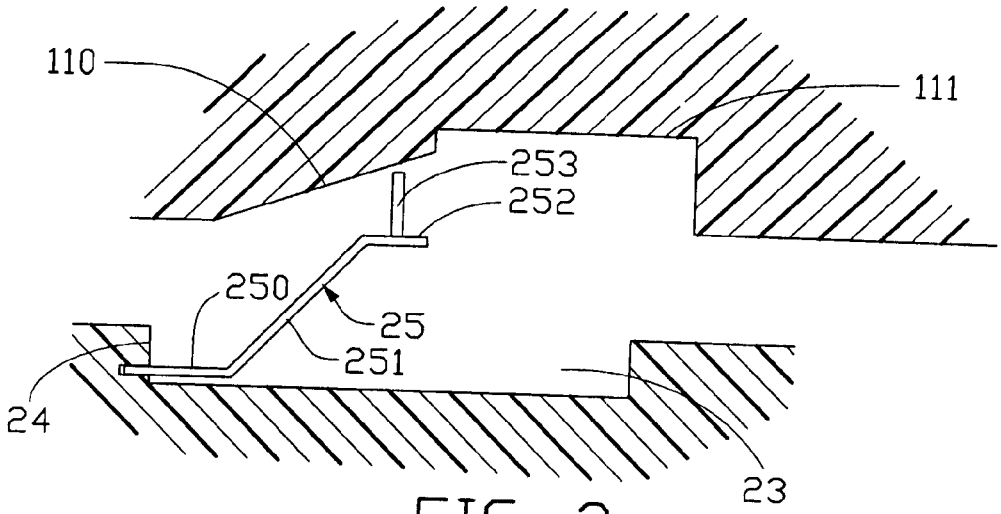
FIGS. 3, 4, and 5 are cross sectional views of the connector couple of FIG. 1 showing progressive stages of mating of the connector couple.
Figure 4:
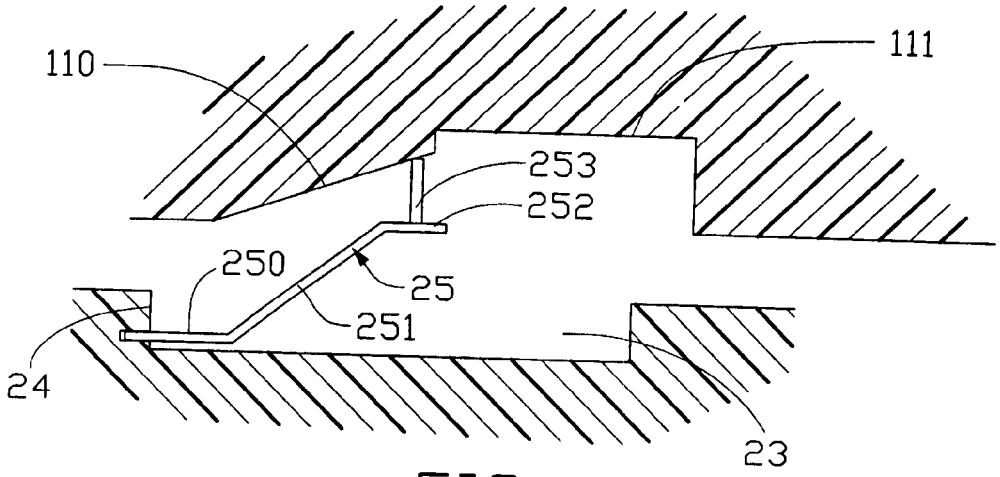
Figure 5:
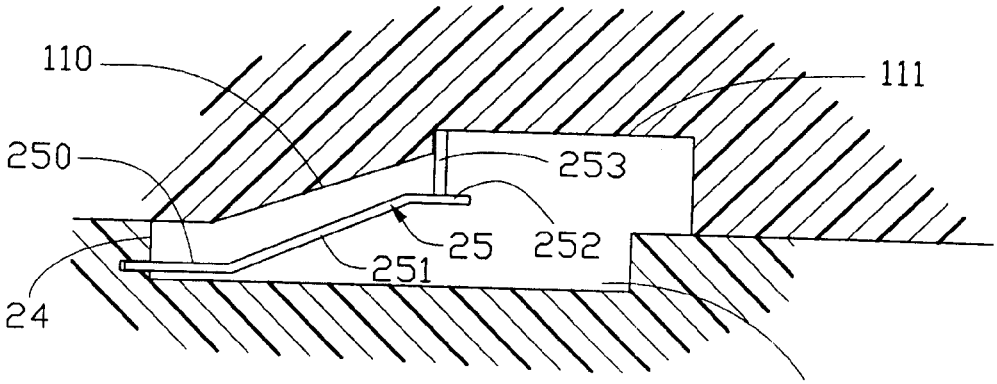
Figure 6:
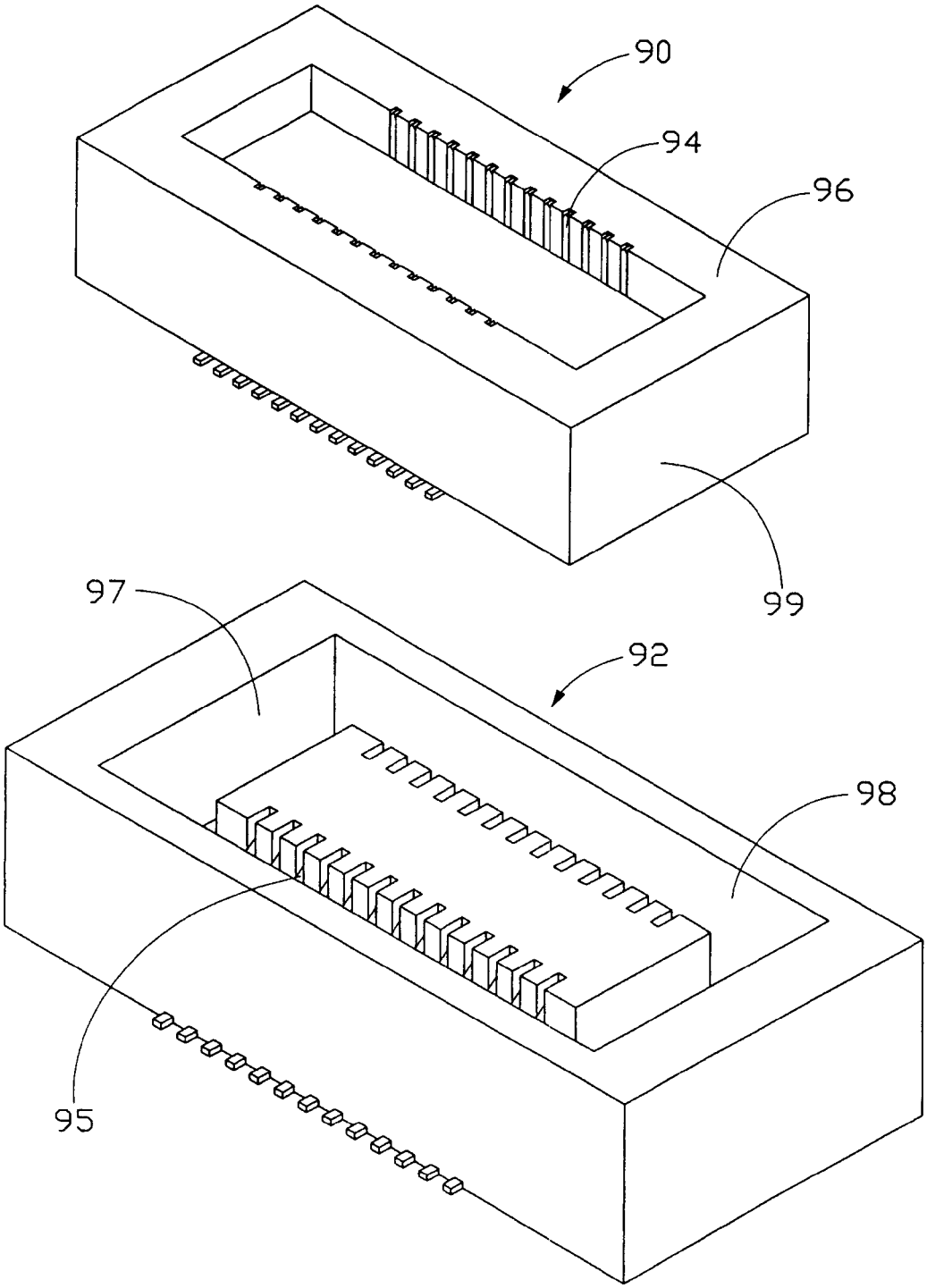
FIG. 6 (PRIOR ART)
FIG. 6 is a perspective view of a conventional connector couple.

Referring to FIGS. 3–5, when the first and second connectors 1, 2 are mated, the raised portion 101 of the first connector 1 is pressed into the receiving portion 202, and the guide portion 110 of the recess 11 presses the pin 253 of the spring tab 25, therefore the extending portion 251 of the spring tab 25 bending downwardly. During the mating course of the connector couple, the extending portion 251 keeps on bending downwardly, and the pin 253 slides along the guide portion 110 continuously. When the connector couple are mated completely, the pin 253 slides beyond the vertical wall 112, and at the same time the spring tab 25 flexes upwardly so the pin 253 hits on the locating portion

111. At this moment, a sound is made to indicate the completeness of the mating of the first and second connectors 1, 2. The pin 253 may be replaced by a spring clip with its own resiliency to increase the restoration force and enhance the click sound.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector couple comprising:

a first connector comprising a fist insulative housing having a concave portion with a first mating surface defined thereon, the second connector comprising a second insulative housing having an island portion with a second mating surface defined thereon, the first mating surface having a recess therein, and a spring tab formed correspondingly on the second mating surface, the recess having a vertical wall; wherein the recess comprising a guide portion and a locating portion on opposite sides of the vertical wall; wherein a hollow portion is defined in the second mating surface of the second connector for receiving and securing the spring tab therein; wherein the spring tab has a retention portion for skiving into the hollow portion; wherein an extending portion extends from the retention portion and above the recess; wherein a contact portion is formed on an end of the extending portion and defines a pin; wherein the spring tab slides beyond the vertical wall to enable the pin to hit on the locating portion to make a sound indicating the completeness of the mating of the first and second connectors, when the first and second connectors are mated together.

* * * * *